US006280299B1

(12) United States Patent
Kennedy et al.

(10) Patent No.: US 6,280,299 B1
(45) Date of Patent: Aug. 28, 2001

(54) COMBINED SLURRY DISPENSER AND RINSE ARM

(75) Inventors: Daniel Kennedy; Boris Fuksshimov, both of San Jose; Victor Belitsky, Sunnyvale; Boris Fishkin, San Carlos; Kyle Brown, Sunnyvale; Tom Osterheld, Mountain View; Jeff Beeler, Campbell; Ginetto Addiego, Berkeley, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/505,577

(22) Filed: Feb. 16, 2000

Related U.S. Application Data

(63) Continuation of application No. 08/879,447, filed on Jun. 24, 1997, now Pat. No. 6,139,406.

(51) Int. Cl.[7] ..... B24B 57/02

(52) U.S. Cl. ..... 451/67; 451/288; 451/446

(58) Field of Search ..... 451/41, 67, 247, 451/288–290, 292, 332, 401, 446

(56) References Cited

U.S. PATENT DOCUMENTS

| | | | |
|---|---|---|---|
| 4,680,893 | 7/1987 | Cronkhite et al. . | |
| 5,154,021 | 10/1992 | Bombardier et al. . | |
| 5,320,706 | 6/1994 | Blackwell | 156/636 |
| 5,421,768 | 6/1995 | Fujiwara et al. | 451/283 |
| 5,486,129 | 1/1996 | Sandhu et al. | 451/5 |
| 5,486,265 | 1/1996 | Salugsugan | 156/636.1 |
| 5,531,861 | 7/1996 | Yu et al. | 156/636.1 |
| 5,562,524 | 10/1996 | Gill, Jr. | 451/1 |
| 5,578,529 | 11/1996 | Mullins | 437/228 |
| 5,611,943 | 3/1997 | Cadien et al. | 216/88 |
| 5,616,063 | 4/1997 | Okumura et al. | 451/1 |
| 5,616,069 | 4/1997 | Walker et al. | 451/56 |
| 5,645,682 | 7/1997 | Skrovan | 156/636.1 |
| 5,651,725 | 7/1997 | Kikuta et al. | 451/41 |
| 5,658,183 | 8/1997 | Sandhu et al. | 451/5 |
| 5,672,095 | 9/1997 | Morimoto et al. | 451/41 |
| 5,679,055 | 10/1997 | Greene et al. | 451/10 |
| 5,679,060 | 10/1997 | Leonard et al. | 451/43 |
| 5,702,563 | 12/1997 | Salugsugan et al. | 156/636.1 |
| 5,704,987 | 1/1998 | Huynh et al. | 134/6 |
| 5,716,264 | 2/1998 | Kimura et al. | 451/443 |
| 5,730,642 | 3/1998 | Sandhu et al. | 451/6 |
| 5,738,574 | 4/1998 | Tolles et al. | 451/288 |
| 5,755,614 | 5/1998 | Adams et al. | 451/68 |
| 5,779,522 | 7/1998 | Walker et al. | 451/56 |
| 5,816,891 | 10/1998 | Woo | 451/6 |
| 5,893,753 * | 4/1999 | Hempel, Jr. | 438/691 |
| 5,916,010 | 6/1999 | Varian et al. | 451/38 |
| 5,916,011 | 6/1999 | Kim et al. | 451/41 |
| 5,934,980 | 8/1999 | Koos et al. | 451/41 |
| 6,053,801 * | 4/2000 | Pinson et al. | 451/56 |

FOREIGN PATENT DOCUMENTS

| | | | |
|---|---|---|---|
| 0754525A1 | 1/1997 | (EP) | B24B/37/04 |
| 08484147A1 | 6/1998 | (EP) . | |
| 0887153A2 | 12/1998 | (EP) | B24B/37/04 |
| 2308010A | 6/1997 | (GB) | H01L/21/304 |
| 3-10769 | 1/1991 | (JP) | B24B/53/10 |
| 07299738 | 11/1995 | (JP) | B24B/37/04 |

OTHER PUBLICATIONS

PCT International Search Report dated Feb. 21, 2000.
PCT International Search Report dated Nov. 24, 1999.

* cited by examiner

*Primary Examiner*—Timothy V. Eley
(74) *Attorney, Agent, or Firm*—Thomason, Moser & Patterson

(57) ABSTRACT

The present invention provides a method and apparatus for delivering one or more rinse agents to a surface, such as a polishing pad surface and preferably one or more polishing fluids. The invention also provides a method of cleaning one or more surfaces, such as a polishing pad surface and a substrate surface, by delivering a spray of one or more rinse agents to the surface and, preferably, causing the rinse agent to flow across the surface from a central region to an outer region where unwanted debris and material is collected.

25 Claims, 10 Drawing Sheets

COMBINED SLURRY DISPENSER AND RINSE ARM

This a continuation of application Ser. No. 08/879,447 filed on Jun. 24, 1997 now U.S. Pat. No. 6,139,406.

BACKGROUND OF THE INVENTION

1. Field of the Invention

The present invention relates to chemical mechanical polishing of wafers, and more particularly to a slurry dispenser and rinse arm and methods of performing chemical mechanical polishing.

2. Background of the Art

Integrated circuits are typically formed on substrates, particularly silicon wafers, by the sequential deposition of conductive, semi-conductive or insulative layers. After each layer is deposited, the layer is etched to create circuitry features. As a series of layers are sequentially deposited and etched, the uppermost surface of the substrate, i.e., the exposed surface of the substrate, may become non-planar across its surface and require planarization. This occurs when the thickness of the layers formed on the substrate varies across the substrate surface as a result of the nonuniform geometry of the circuits formed thereon. In applications having multiple patterned underlying layers, the height difference between the peaks and valleys becomes even more severe, and can approach several microns.

Chemical mechanical polishing (CMP) is one accepted method of planarization. In a typical CMP system as shown in FIG. 1, a substrate 12 is placed face down on a polishing pad 14 located on a large rotatable platen 16. A carrier 18 holds the substrate and apples pressure to the back of the substrate to hold the substrate against the polishing pad during polishing. A retaining ring 20 is typically disposed around the outer perimeter of the substrate to prevent the substrate from slipping laterally during polishing. A slurry is delivered to the center of the polishing pad to chemically passivate or oxidize the film being polished and abrasively remove or polish off the surface of the film. A reactive agent in the slurry reacts with the film on the surface of the substrate to facilitate polishing. The interaction of the polishing pad, the abrasive particles, and the reactive agent with the surface of the substrate results in controlled polishing of the desired film.

One problem encountered in CMP is that the slurry delivered to the polishing pad may coagulate and along with the material being removed from the substrate may clog the grooves or other features on the pad thereby reducing the effectiveness of the subsequent polishing steps and increasing the likelihood of poor defect performance. Accordingly, rinse arms have been incorporated in some CMP systems to deliver de-ionized water or other rinse agents to the pad to facilitate rinsing of the pad of coagulated slurry and other material in the grooves and on the surface of the pad. One rinse arm, disclosed in U.S. Pat. No. 5,578,529, includes a rinse arm with spray nozzles positioned along its length to deliver a rinse agent at a pressure slightly higher than ambient to the surface of the pad. Another rinse assembly, provided by Applied Materials, Inc., Santa Clara, Calif., combines a rinse line and one or more slurry delivery lines in a single fluid delivery arm which delivers the rinse agent and/or the slurry to the center of the pad. This assembly is described in co-pending U.S. patent application Ser. No. 08/549,336, entitled "Continuous Processing System for Chemical Mechanical Polishing."

However, each of these rinse assemblies has several drawbacks. First, the rinse arm disclosed in the noted patent is prone to splashing which may transfer particles or other unwanted debris from one polishing pad to an adjacent polishing pad. In addition, the rinse arm is fixed in its position over the pad so that the pad cannot be easily removed. Still further, the rinse arm must be disposed over the center of the pad in order to deliver the rinse agent to that portion of the pad. Depending on the location of the substrate carrier relative to the pad, rinsing of the central portion of the pad may not be accomplished unless the substrate carrier is moved from the pad and polishing steps are discontinued.

The rinse assembly described in U.S. patent application Ser. No. 08/549,336 is limited in that the rinse agent is not delivered with force to the pad along the length of the rinse arm. In addition, the rinse agent is delivered at the center of the pad or where ever the dispensing end of the delivery channel is positioned.

Therefore, there exists a need to provide a rinse and slurry delivery system which is moveable from a position over the polishing pad, which does not cause uncontrolled splashing of the rinse agent, and which delivers the rinse agent over the entire surface of the polishing pad without having to be located over the entire pad.

SUMMARY OF THE INVENTION

The present invention provides a fluid delivery assembly comprising a rotatable arm defining one or more slurry deliver channels and one or more rinse agent delivery channels. Preferably, a series of nozzles are disposed on the arm and connected to the rinse agent delivery channels to deliver one or more rinse agents to a surface at a pressure above ambient. In one embodiment, a splash guard is disposed downwardly from the arm adjacent the rinse agent delivery channels to confine the effects of splashing caused by the delivery of a rinse agent and to create a channel for enhanced removal of particles from the pad. In another aspect, the nozzles can be disposed on the arm at an angle relative to the plane of the arm to deliver fluid directionally across a selected surface a non-perpendicular angle thereto to provide a sweeping effect on the surface. Alternatively, nozzle spray patterns can be selected to deliver fluid directionally to the surface.

In one aspect, at least one nozzle is adapted to deliver a rinse agent to the center of the pad, or near the center of the pad, without the need to extend the arm thereover. This can include a nozzle which is disposed over the center of the pad or a nozzle disposed on the rinse arm near the center of the pad. Preferably, the rinse arm does not extend over the center of the pad. Additionally, one or more nozzles may be adapted to deliver a rinse agent downwardly onto the surface or in a direction towards the edge of the pad to facilitate removal of the rinse agent and collected material from the pad.

In another aspect, the present invention provides a CMP method which provides a polishing step and a pad rinsing step following each polishing step to reduce the number of particles on each wafer and improve the repeatability of each polishing step by conditioning the pad prior to each processing step. Preferably, the rinse step is initiated prior to the substrate being removed from the pad and continues until another substrate is positioned for processing or until the pad is cleaned. In a multi-pad system, the rinse step is preferably performed at each station. Alternatively, a final rinse station may be included where the substrate undergoes additional cleaning following polishing at other pads.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides a fluid delivery assembly for a chemical mechanical polishing apparatus having at least one rinse agent delivery line and preferably one slurry delivery line. In one aspect of the invention, the rinse agent delivery line has one or more spray nozzles disposed thereon along its length to deliver a spray of rinse agent to a surface above ambient pressure and a splash guard to contain the spray from the nozzles and control cross contamination of other system components or wafers. In a preferred embodiment, the fluid delivery assembly is rotatably mounted adjacent the surface to which it is intended to deliver the rinse agent and/or slurry to provide easy access to the surface for replacement and or other maintenance. Additionally, sweeping nozzles may be disposed on the arm to urge rinse agent and debris towards and off the edge of the surface being cleaned.

The invention further provides cleaning and polishing processes wherein a rinse agent is delivered to a surface, such as a polishing pad surface, while a substrate is still in contact with the pad and shortly thereafter to rinse the substrate and the surface. The processes have the advantage of at least increasing substrate throughput by substantially performing a rinse step while a substrate is being loaded/unloaded from a carrier or while the carriers are rotated to another processing station. Another advantage is that the rinse step lowers the number of particle defects associated with each substrate by rinsing the substrate prior to removal from the pad and then continuing to rinse the pad before another substrate is positioned thereon for processing.

Figure 1:
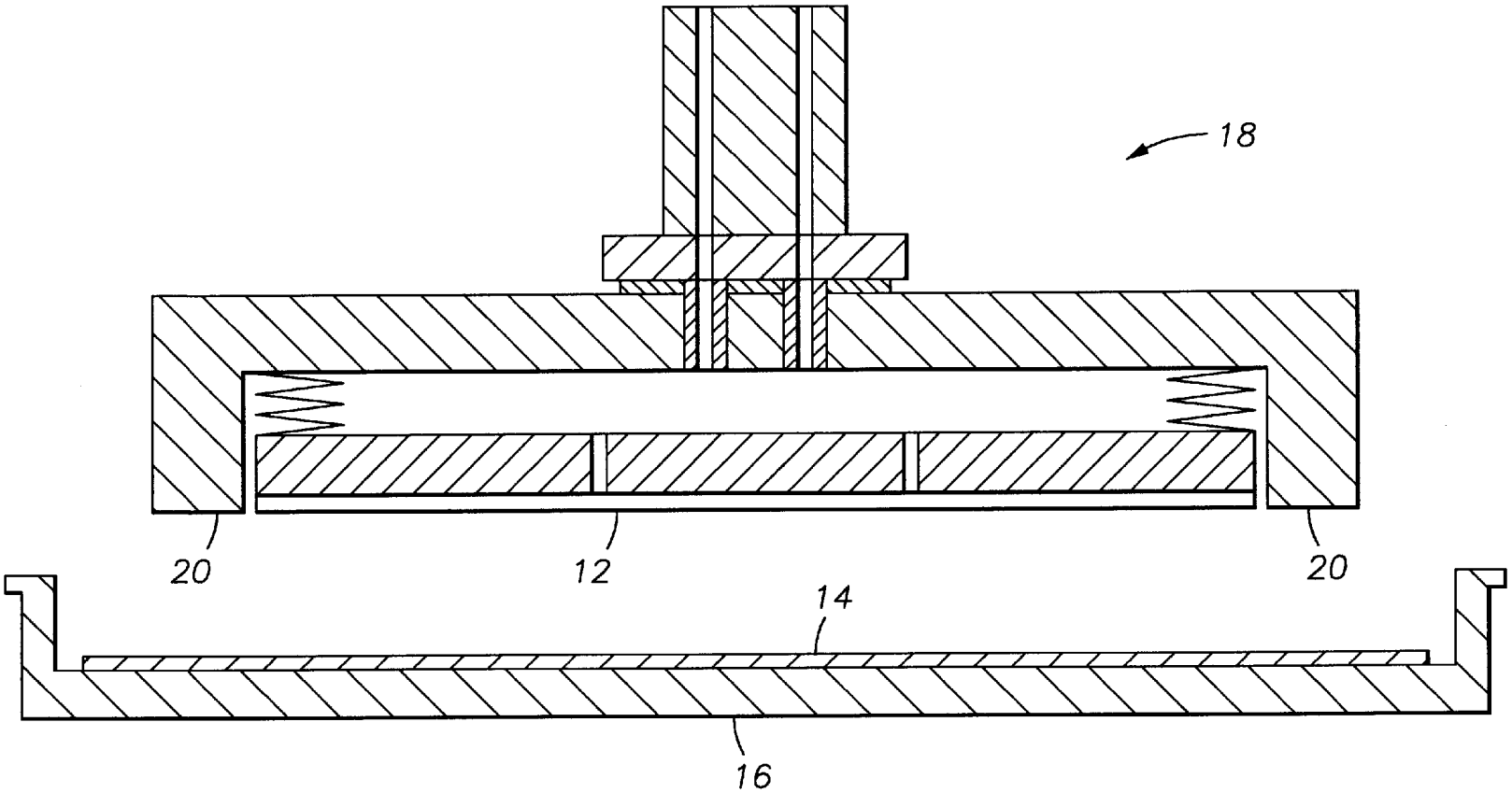
Fig. 1 (PRIOR ART)
FIG. 1 is a side view of an exemplary chemical mechanical polishing apparatus known in the art.
Figure 2:
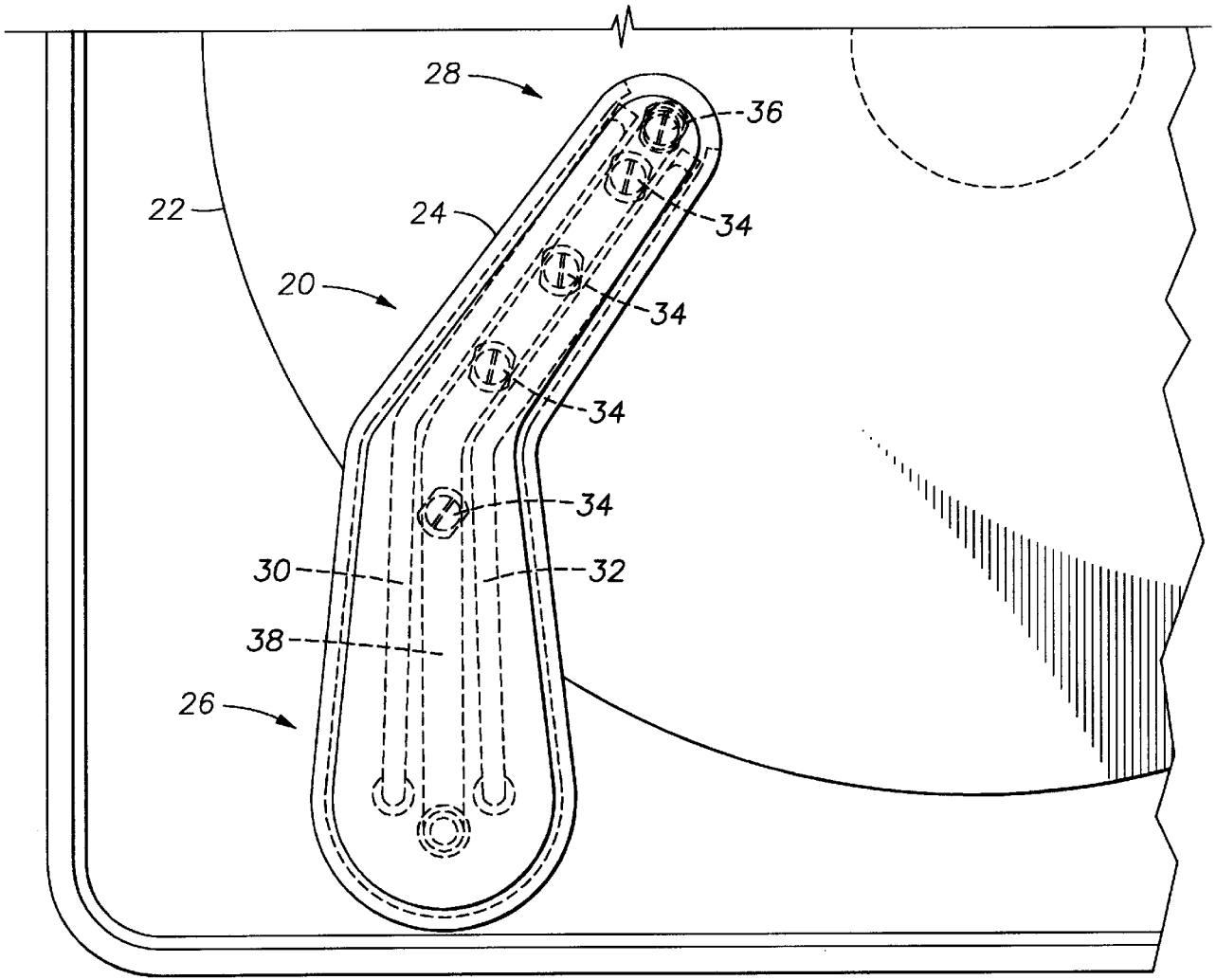
FIG. 2 is a top view of one embodiment of a fluid delivery arm and related hardware of the present invention.

FIG. 2 is a top view of a CMP system having one embodiment of a fluid delivery system 20 of the present invention disposed over a polishing pad 22. The fluid delivery system includes a delivery arm 24 having a base portion 26 disposed outwardly from the edge of the pad and an end portion 28 disposed over the pad. The base portion 26 is mounted on a shaft 40 (shown in FIGS. 3*a*, 3*b*, 3*c* and 6) to enable rotation of the fluid delivery system 20 between a processing position over the polishing pad and a maintenance position adjacent the pad. The arm is generally angled along its length from its base portion 26 to its end portion 28, though it may be straight, and includes two slurry delivery lines 30, 32 mounted on or disposed within the fluid delivery arm 24. Preferably, tubing is used as the slurry delivery lines and one or more slurries are pumped from one or more slurry sources using a diastolic pump or some other type of pump out through the end of the tubing. A central rinse agent delivery line 38 delivers one or more rinse agents to a plurality of nozzles 34, 36 mounted to the lower surface 44 of the fluid delivery arm. The end portion 28 preferably terminates at a position short of the center of the pad 22 to allow the carrier holding the substrate to move radially across the pad approaching or even over the center of the pad during polishing without the risk of having the arm collide with the carrier. A nozzle 36 is disposed on the end portion of the arm at an angle to the plane of the arm to deliver one or more rinse agents to the center of the pad. Alternatively, a straight arm or an angled arm extends over the center of the pad and mounts a nozzle 34 at or near the distal end of the arm to deliver rinse agent to the central portion of the pad. Typical house pressures range from about 15 psi up to about 100 psi, this range being sufficient to deliver the rinse agent to the pad at a pressure higher than ambient. Preferably, the rinse agent is delivered at a pressure of about 30 psi or higher.

Figure 3A:
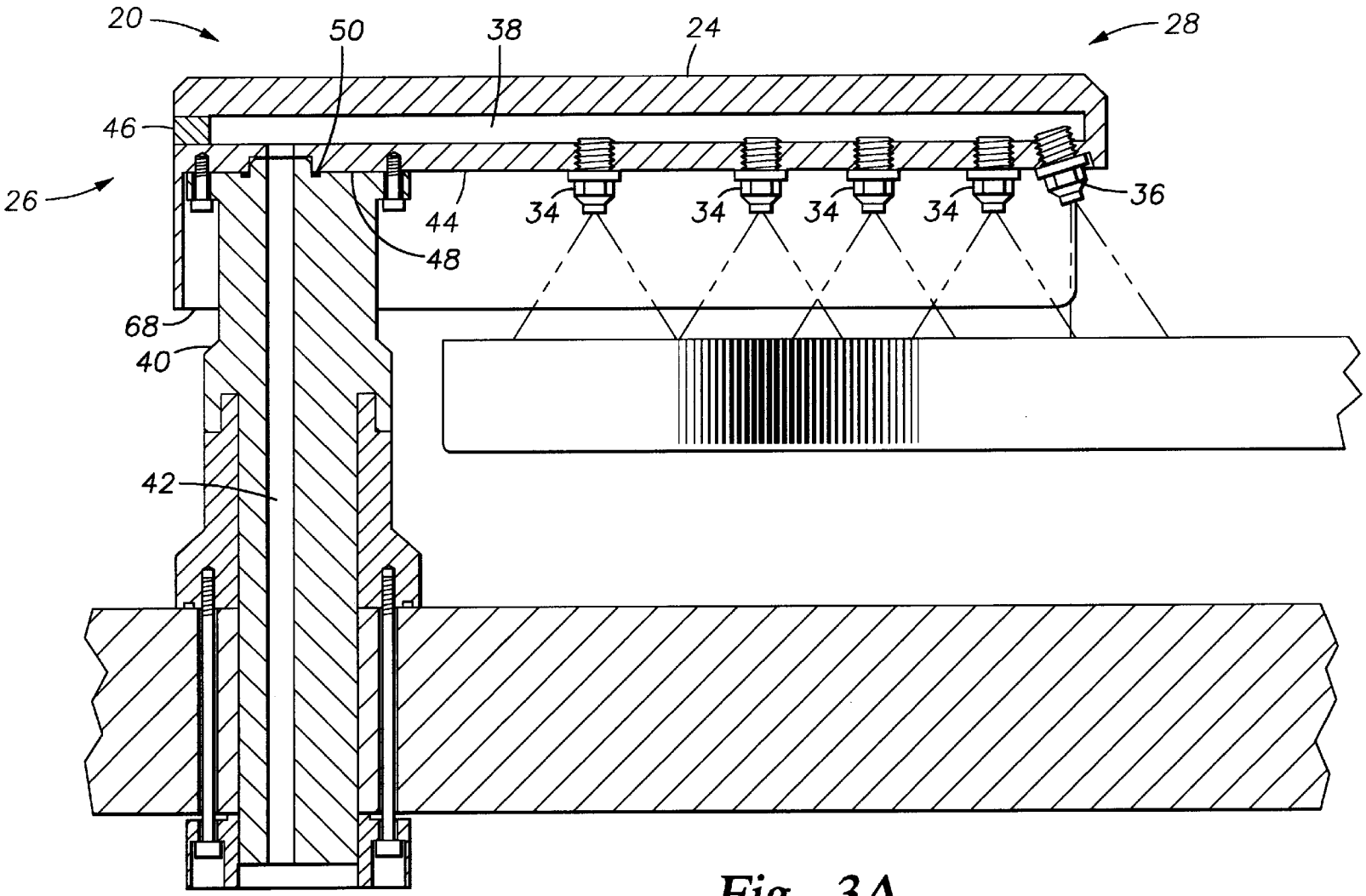
FIG. 3*a–c* and 4*a–d* are cross sectional and schematic views of alternative embodiments of a fluid delivery arm showing the rinse agent delivery channel and the spray patterns and arrangements of the nozzles.

FIG. 3*a* is a cross sectional view of the fluid delivery assembly 20 of FIG. 2 showing the rinse agent delivery line 38 and the mounting shaft 40. The shaft 40 defines a rinse agent channel 42 along its length which delivers a fluid to the fluid delivery arm 24. The arm similarly defines a channel or delivery line 38 along its length which terminates at the end portion 28. In alternative embodiments shown below, the rinse agent channel or delivery line 38 may include extensions to deliver fluid to sweeping nozzles 37 which will be described below. A plug 46 may be disposed in one end or both ends of the channel depending on the process used to machine the channel or line 38. The rinse agent channel 42 delivers one or more rinse agents to the channel or fluid delivery line 38 of the arm 24 from a source provided in conjunction with a CMP system. A seal is provided between the shaft 40 and the arm 24 and will be described in more detail below in reference to FIG. 5. The channels 42, 38 may be machined channels or may be tubing disposed through and secured in each of the shaft and the arm.

A series of nozzles 34, 36 are threadedly mounted in or otherwise disposed on the lower surface 44 of the arm and are connected to the rinse agent delivery line 38. In one embodiment, five spray nozzles are threadedly mounted along the length of the arm having the spray patterns shown. The end nozzle 36 is disposed at an angle to the plane of the arm, e.g., an acute angle, to deliver a fluid a distance away from the end portion 28 of the arm towards the central portion C of the pad 14. The nozzles are preferably fine tipped nozzles which deliver the rinse agent in a fan-shaped plane to reduce the effects of splashing caused by the spray of rinse agent contacting the pad surface. On example of nozzles which can be used to advantage are available from Spraying Systems company, Wheaton, IL, under model Veejet Spray Nozzle, Kynar® Series. In a preferred embodiment, the nozzles deliver fluid in an overlapping pattern to insure that a substantial portion of the pad is subjected to the spray from the nozzles. The end nozzle 36 is positioned to deliver fluid outwardly beyond the end of the arm to cover the remaining pad regions, including the central portion of the pad, while also preferably overlapping the spray from the adjacent nozzle to insure that each region of the pad is cleaned. While it is preferred to overlap the spray patterns, it is not necessary that each spray pattern overlap the adjacent patterns.

Figure 3B:
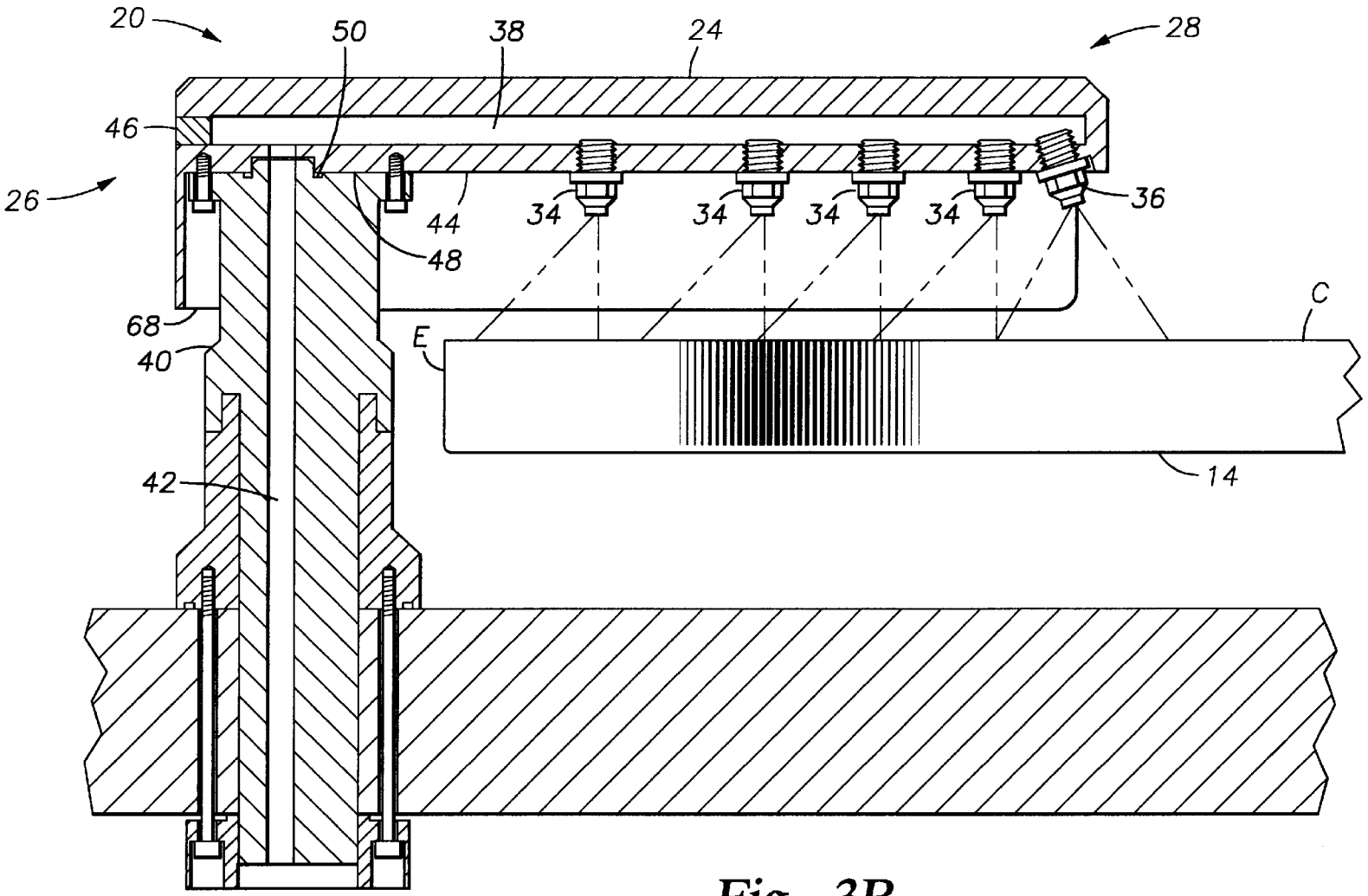
Figure 3C:
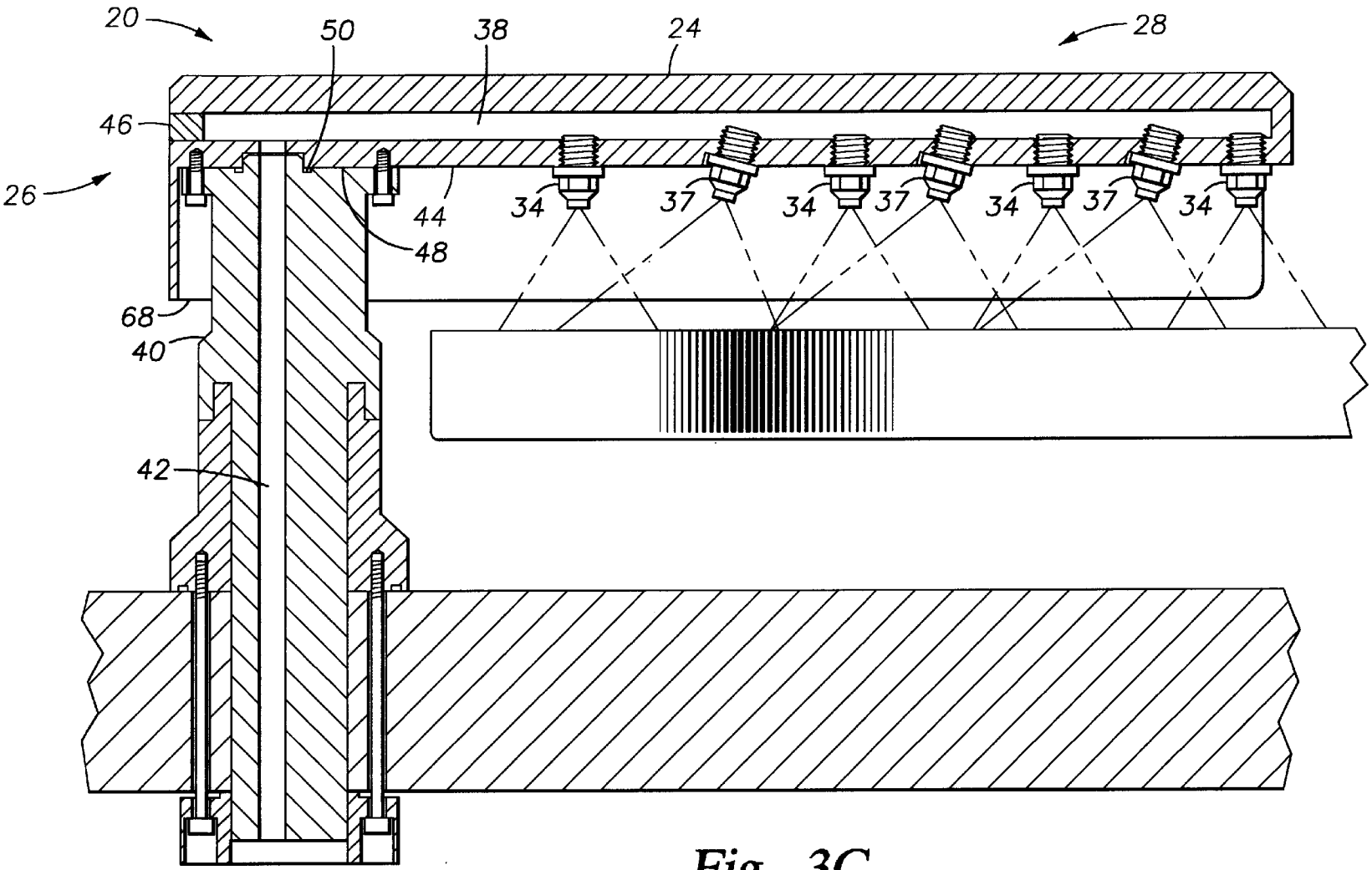

In another embodiment, the nozzles may include spray patterns which direct the rinse agent downwardly and outwardly over the surface of the pad towards the edge E of the pad 14. As one example, nozzles having a fan shaped pattern directed outwardly towards the base of the arm 26, as shown in FIG. 3*b*, may be employed. Alternatively, as shown in FIG. 3*c*, sweeping nozzles 37 are interspersed with nozzles 34, and may be mounted in the arm at a non-perpendicular angle from the plane of the rinse arm. Sweeping nozzles 37 thereby direct the spray from nozzles 34 and 37 and sweep accumulated rinse agent and debris towards the outer edge E and then off of the pad 14. As an example of an embodiment of the present invention, arm 28 as shown in FIG. 3*c* extends over the center C of the polishing pad 14.

It is believed that directing the spray via sweeping nozzles 37 downwardly and outwardly over the pad surface may enhance removal of material and cleaning of the pad surface. Preferably, nozzles 34 and 36 are disposed to deliver a spray of rinse agent directly to the pad while sweeping nozzles 37 are disposed to enhance removal of material and rinse agent from the pad. Nozzles 34 and 36 direct rinse agent, set at an optimal pressure to provide sufficient volume of rinse agent between pad 14 and the rinse arm 28 and shield member 68, such that a disturbance is caused, and particles are thereby lifted and suspended in the volume of liquid. Preferably, the angled spray from nozzles 37, also set at an optimal pressure to direct the suspended particles and the rinse agent off of the pad, i.e., thereby sweeping the pad clean of particles and fluid and enhancing removal of rinse agent and debris from the pad 14. Sweeping nozzles 37 have particular application in those processes where heavy materials are used or heavy build-up of slurry, agglomerates and/or wafer debris occurs during polishing.

Figure 4A:
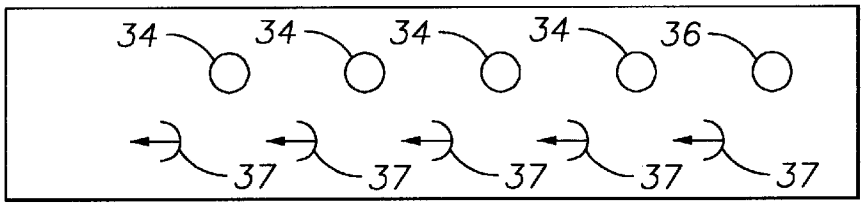

FIGS. 4*a–d* are schematic representations of other alternative embodiments of nozzles and spray patterns for delivering the rinse agent to the pad. The embodiments include the nozzles 34 and 36 as depicted in FIGS. 3*a–c* and additional sweeping nozzles 37, as shown in FIG. 3*c*, disposed in the arm 24 or otherwise adapted to deliver a rinse agent at a non-perpendicular angle to the surface of the pad. FIG. 4*a* shows the nozzles 34 and 36 offset from center on the arm 24 and adjacent sweeping nozzles 37 disposed adjacent thereto. The sweeping nozzles 37 may be laterally aligned with or offset from the nozzles 34 and 36. FIGS. 4*a–d* show the sweeping nozzles 37 offset from the nozzles 34 and 36.

Figure 4B:
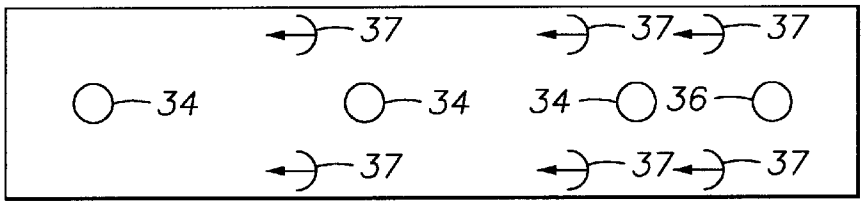
Figure 4C:
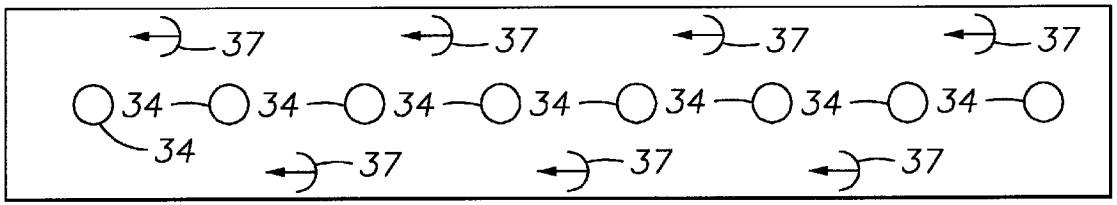
Figure 4D:
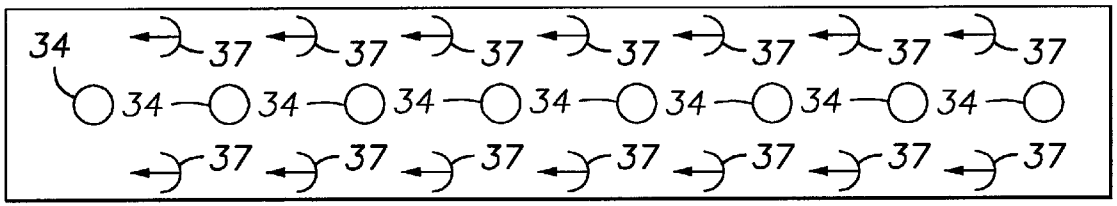

FIG. 4*b* shows the nozzles 34, 36 centrally disposed along the length of the arm and two rows of sweeping nozzles 37 disposed along each side of the arm. These sweeping nozzles 37 may be aligned with or offset from the nozzles 34, 36. FIG. 4*c* is a further modification showing a staggered pattern for the two rows of sweeping nozzles 37. FIG. 4*d* shows still another embodiment incorporating an additional nozzle 34 and an additional pair of sweeping nozzles 37. The nozzles 34 disposed at the end of the arms shown in FIGS. 4*c* and 4*d* extend over the center of the pad, or at least close to the center of the pad, to deliver a rinse agent to the central portion of the pad. The number and arrangement of the nozzles 34, 36, 37 can be varied depending on the size of the pad and the materials used, including the slurry material, the pad material, the material to be polished, the water volume and water pressure, etc. In addition, the nozzles and lines supplying fluid to the nozzles 34, 36, 37 are arranged to allow the slurry delivery lines to be routed along the length of the arm.

Figure 5:
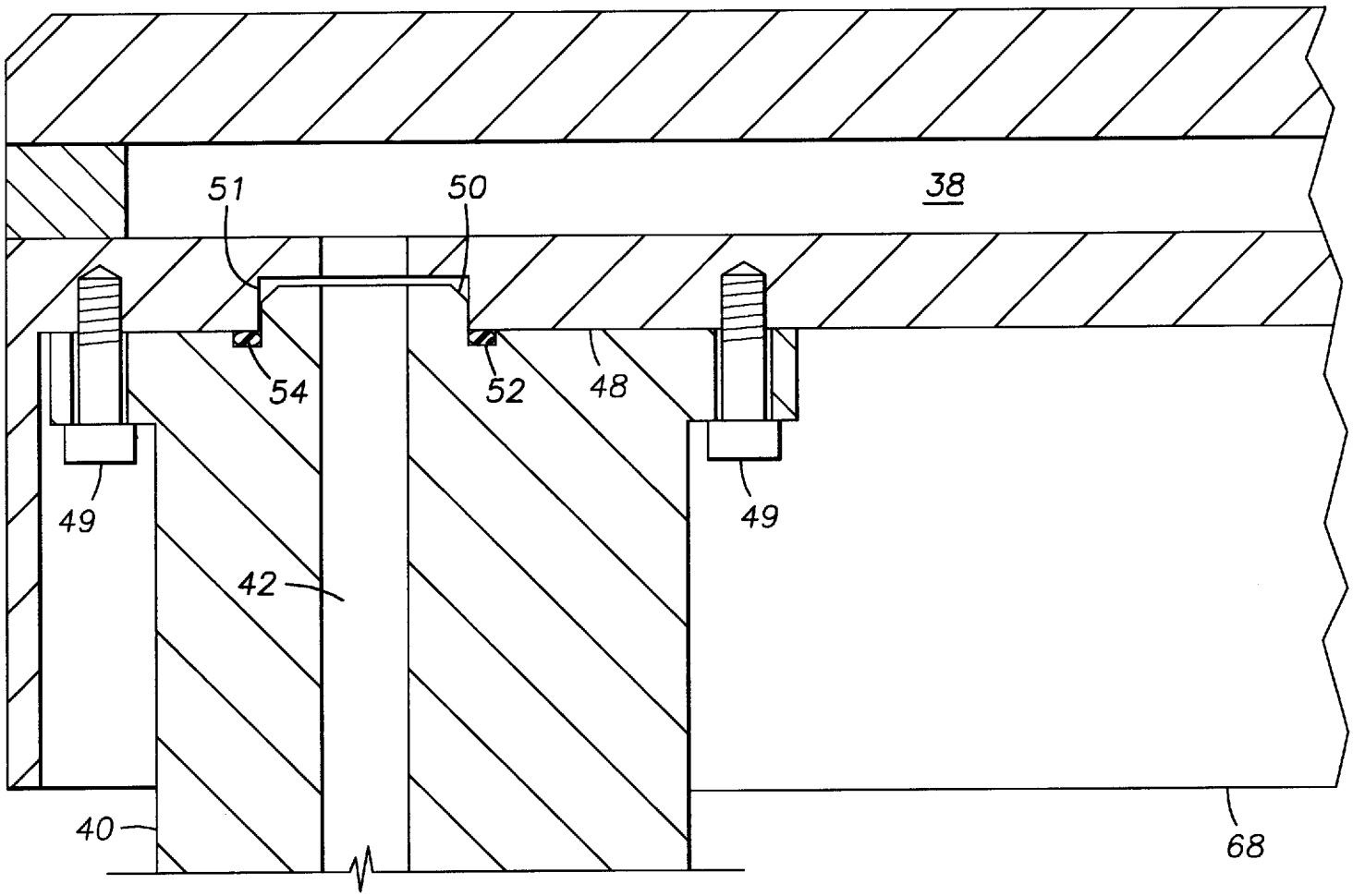
FIG. 5 is a detailed view of a seal assembly for the rinse agent delivery channel.

FIG. 5 is a detailed section of the connection between the arm 24 and the shaft 40 which shows the seal between the channels 38, 42 formed in each of the arm and the shaft. Preferably, the top of the shaft has a planar mating surface 48 on which the arms mounted. The arm is secured to the shaft 40 using screws 49 or other connecting member/arrangement. An annular coupling 50 is formed around the channel 42 at the upper end of the shaft and mates with a recess 51 formed in the lower surface of the arm 24. An o-ring groove 52 is formed in the mating surface 48 on the upper end of the shaft 40 to mount an o-ring 54 for sealing the shaft with the arm. The chamfered edges of the coupling 50 provide ease of assembly.

Figure 6:
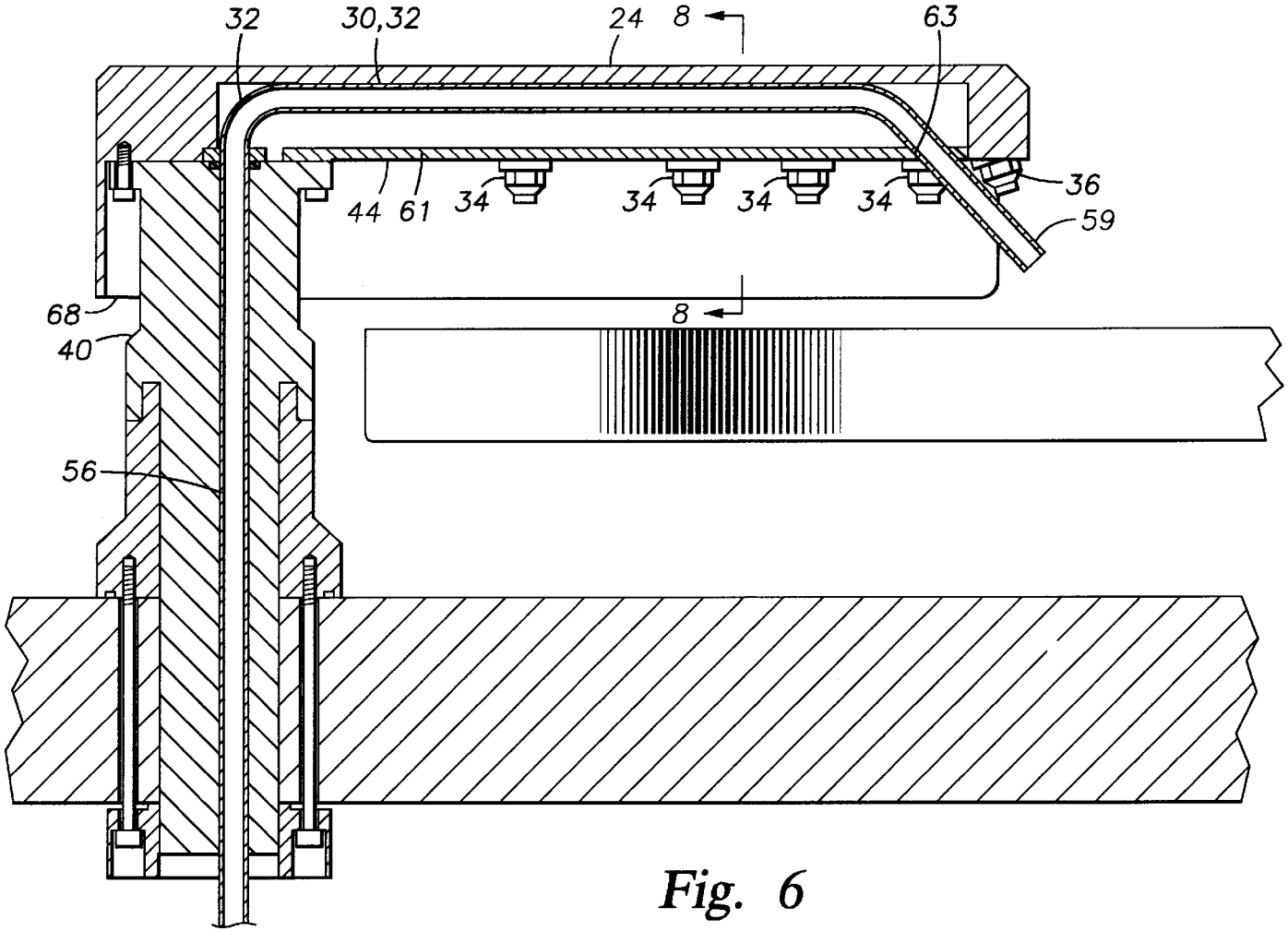
FIG. 6 is a partial sectional view of one embodiment of a fluid delivery arm showing a rinse agent delivery nozzles and one slurry delivery tube.

FIG. 6 is a cross sectional view showing one of the slurry delivery lines 32 disposed on the arm 24 and through the shaft 40. The slurry lines 30, 32 are preferably made of a removable tubing disposed through a channel 56 formed in the shaft 40 and mounted in a pair of channels 58 (shown in FIG. 8) formed in the lower surface 44 of the arm. A cover 61 is mounted to the lower surface of the arm to secure the tubing in place within the channels 58. Alternatively, the lines can be press fitted into the grooves 58 and secured by brackets or other fittings therein. The ends 59 of the slurry delivery lines 30, 32 are routed through a pair of channels 63 formed in the cover 61 and out of the end of the arm 24 to deliver the slurry to the pad. The channels 63 can be located and angled to position the dispensing ends of the tubes adjacent the center of the pad so that a slurry can be dispensed thereto.

Figure 7:
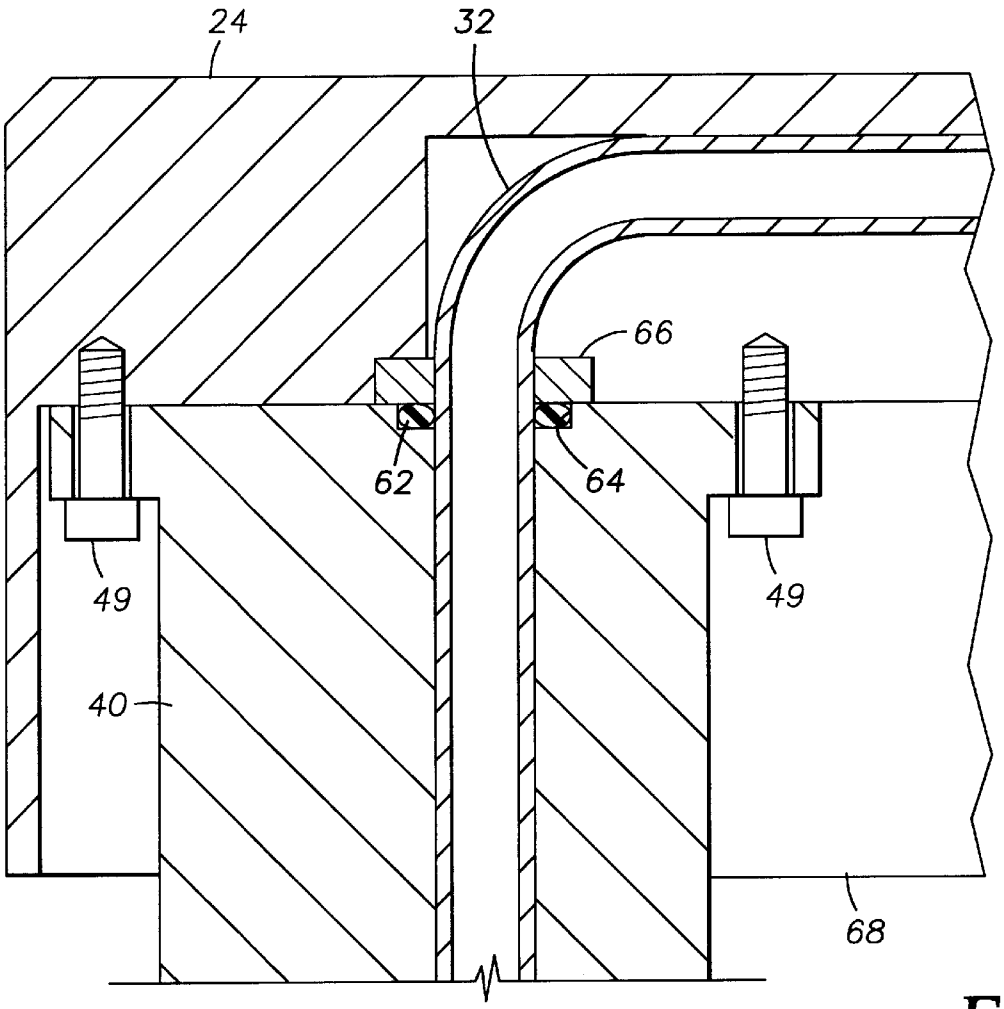
FIG. 7 is a detailed view of a seal assembly for the rinse agent delivery channel.

FIG. 7 is a detailed section of the connection between the arm 24 and the shaft 40 which shows the seal around the tube 32. The seal is formed around the tubing 32 at the interface of the arm 24 and shaft 40 by disposing a washer 60 around the tubing adjacent an o-ring 62 disposed in an o-ring groove 64 formed in the mating surface of the shaft. The washer 60 is housed in a recess 66 formed in the lower surface of the arm.

Figure 8:
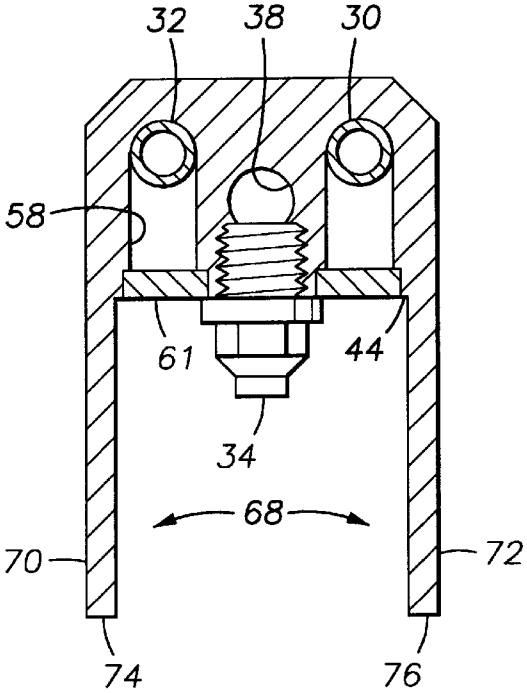
FIG. 8 is a flow diagram describing one rinsing method of the present invention.

FIG. 8 is a cross sectional view through the am assembly along line 8—8 in FIG. 6 showing the relationship of the slurry delivery lines 30, 32, the rinse agent channel 38 and the nozzles 34. A shield member 68 extends downwardly from the lower surface 44 of the arm and includes two walls 70, 72 which confine at least a portion of the rinse agent spray therebetween. The lower edges 74, 76 of the shield member 68 are positioned above the surface of the pad, or other surface onto which the fluids are delivered, to allow material to pass thereunder while also effectively pooling the rinse agent between the walls 70, 72. The lower edges 74, 76 and the upper surface of the pad define a passage through which the rinse agent and the slurry may flow. The distance between the lower edge of the shield and the surface of the pad is preferably optimized according to flow rates of slurry, rinse agent and rotational speed of the pad. Preferably, the distance between the lower edge of the shield and the pad is in the range of about 1 to about 5 mm when a rinse agent flow rate is in the range of between 230 ml/min. and about 6000 ml/min., at a pressure in the range of between about 15 psi to about 100 psi. These ranges are only representative and are not to be considered limiting of the scope of the invention because other distances and flow rates could be selected depending on the conditions and materials used or subjected to a particular process. For example, at a pressure of 60 psi, a flow rate of 5.15 l/min. shows satisfactory particle and rinse agent removal from the polishing pad surface. The flow rate of the rinse agent and the distance between the lower edge of the shield and the substrate can be set so that a wave of rinse agent can be accumulated and swept across the surface of the pad and directed outwardly over the pad so that the pad and the substrate can be cleaned. As the polishing pad rotates, in combination with the angled contour of the arm and shield as shown in FIG. 2, the rinse agent and excess material are carried towards the edge of the pad E where the resulting material can be removed. It is understood, however, that a substantially straight arm may be used, and will also provide advantageous effects, by the present invention.

The fluid delivery assembly, i.e., the arm 24 and the shield member 68, is preferably made of a rigid material, such as polypropylene, which is chemically inert and will not adversely react with the polishing materials used in CMP processes. The material must be sufficiently rigid so that the structure does not sag or droop along its length. The slurry delivery lines are preferably made of a tubing material, such as Teflon®, which is not reactive with the various slurries used in CMP processes.

Figure 9:
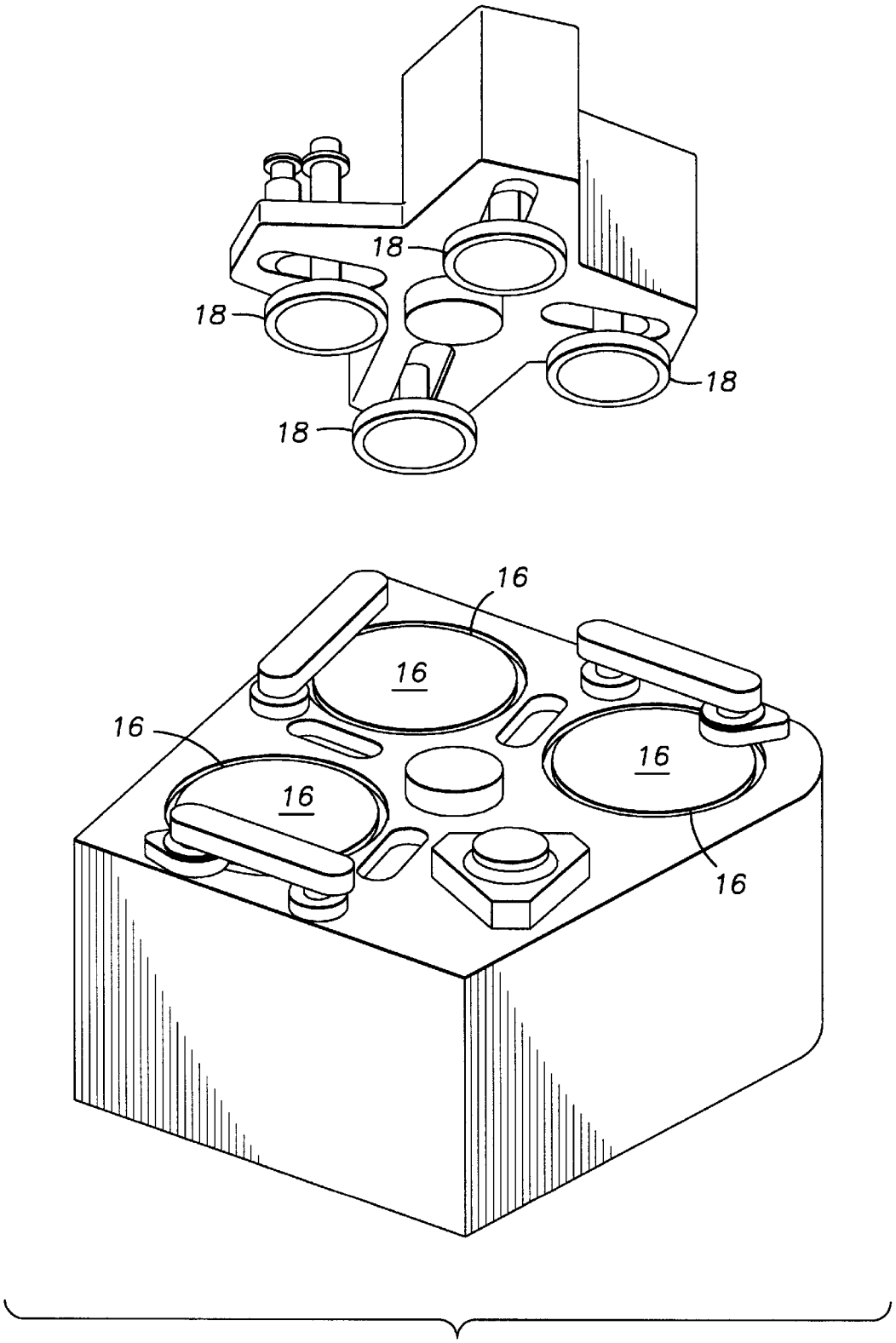
FIG. 9 is a schematic of a multi-pad system.

The methods of the present invention will now be described in detail below. It should be recognized that each of the methods of the present invention may be practiced on a single or a multi-pad system. FIG. 9 is a multi-pad system representative of the MIRRA™ system available from Applied Materials, Inc. of Santa Clara, Calif. Typically, a substrate is positioned or chucked to a carrier which positions a substrate on the polishing pad and confines the substrate on the pad. The polishing pad 14 is typically rotated and the substrate may also be rotated within the carrier 18. Additionally, the carrier may be moved radially across the surface of the polishing pad to enhance uniform polishing of the substrate surface. Once the substrate is located in the carrier and the carrier is located over the polishing pad, a slurry is typically delivered to the polishing pad. The slurry can comprise any number of materials, such as sodium hydroxide, or may just be deionized water if used on a rinse pad. The carrier is then lowered over the polishing pad so that the substrate contacts the pad and the substrate surface is then polished according to a pre-selected recipe. Towards the end of the polishing step, a rinse agent, such as water, deionized water, sodium hydroxide, potassium hydroxide or other known agent, is delivered to the pad via the nozzles 34, and/or 36, 37 on the rinse arm to rinse the polishing pad and the substrate. The rinse agent is delivered to the polishing pad for a period of about 5 to about 20 seconds during which time the substrate is raised from the polishing pad 14 and the carrier 18 is moved either to the next processing position in multiple polishing pad systems and/or into position for unloading the substrate and loading the next substrate for processing.

It is believed that a wave of rinse agent formed between the walls 72, 74 of the shield 68 forms a suspension layer on the substrate and on the polishing pad into which the removed material and other particles are collected and swept under centrifugal force or the force of the spray to the edge of the pad where it can be removed or filtered from the system. Preferably, the polishing pad continues to rotate as the rinse agent is delivered to the pad. The rinse step may continue until another substrate is positioned in the carrier 18 and the carrier is moved to a process position. Preferably, the rinse step is performed for about ten to about fifteen seconds while the carriers on a multi-carrier/pad system are rotated and an unloading/loading step is performed at the loading/unloading station.

In a three polishing pad system, such as the MIRRA™ system available from Applied Materials, Inc., Santa Clara, Calif., a preferred polishing sequence includes two polishing stations, a rinse station, and a load station. The first two polishing stations preferably mount a first and a second polishing pad, such as an IC 1000 pad from Rodel, Inc., and the rinse station preferably mounts a rinse pad, such as a Politex pad also from Rodel, Inc. Four substrate carrier heads 18 mount on a central carousel disposed above the pads and which can be sequentially rotated to position a substrate in the four different stations mentioned above.

According to one polishing method of the present invention, a substrate undergoes polishing at the first polishing station and then at the second polishing station. A polishing step and recipe are selected to polish the desired material(s) to achieve the desired results. Multiple polishing steps, recipes, pads etc. can be employed to achieve these results. The substrate is then moved to the rinse station where a rinse agent is delivered to the rinse pad and the substrate is disposed on the pad by the carrier head. According to the present invention, a pad/substrate rinse step is performed at each station. Preferably, the pad/substrate rinse step is performed towards the end of the polishing step and continues until another substrate is positioned over the pad. Once the polishing step is substantially complete, a rinse agent is delivered to the pad for a period of a few seconds, e.g., for about 3 to about 60 or more seconds, as the system prepares to lift the substrate from the pad to rinse at least a portion of the residue of polished material and slurry from the pad and the substrate. The rinse step then continues as the substrate is removed from the pad and the carrier head carousel is rotated to the next station to position a substrate adjacent to a pad for continued processing or for unloading. Preferably, the rinse step is performed substantially during cross rotation of the carrier heads, i.e., when the carrier heads are rotated to the next position, so that substrate throughput is not adversely affected. During the rinse step, rotation of the platen 16 and pad 14 continue so that the centrifugal force urges the rinse agent and the slurry material radially towards the edge of the pad and into a collecting area. Preferably, the pad is rotated at a rate of from about 80 to about 150 revolutions per minute, most preferably from about 95 to about 115 rpm. Additionally, in one embodiment, nozzles 37 assist in moving material and rinse agent across the surface of the pad.

In another embodiment, polishing pads may be mounted on all three platens and the rinse step performed at each polishing pad. In this embodiment, the substrate cleaning step is preferably performed on the third pad. A rinse step is performed on each polishing pad as described above. However, the additional rinse step performed at the third pad has been found to enhance defect performance by increasing the time during which the substrate is in contact with the rinse agent. As a result, the rinse pad at the third platen is also maintained in a very clean state.

While the foregoing is directed to a preferred embodiment of the present invention, other and further embodiments of the invention may be devised without departing from the basic scope thereof, and the scope is determined by the claims which follow.

What is claimed is:

1. A substrate polishing apparatus for supplying one or more fluids, comprising:

a) a fluid delivery arm;

b) one or more fluid delivery lines extending at least partially along a length of the fluid delivery arm; and c) a shield member disposed from the fluid delivery arm on at least one side of the fluid delivery arm and adapted to reduce splashing of the one or more fluids outwardly of the shield member.

2. The substrate polishing apparatus of claim 1, further comprising a base having the fluid delivery arm rotatably connected thereto, wherein the fluid delivery arm extends radially outwardly from the base.

3. The substrate polishing apparatus of claim 1, wherein the one or more fluid delivery lines comprises a first delivery line connected to a source of slurry and a second delivery line connected to a source of rinse agent.

4. The substrate polishing apparatus of claim 1, further comprising one or more nozzles connected to the one or more fluid delivery lines.

5. The substrate polishing apparatus of claim 4, wherein at least one of the one or more nozzles is disposed downwardly from the fluid delivery arm.

6. The substrate polishing apparatus of claim 4, further comprising a base having the fluid delivery arm rotatably connected thereto, wherein the fluid delivery arm extends radially outwardly from the base and wherein at least one of the one or more nozzles is oriented in an inward direction toward the base.

7. The substrate polishing apparatus of claim 4, wherein the shield member comprises a first and a second wall portion disposed on opposite sides of the one or more nozzles.

8. The substrate polishing apparatus of claim 4, wherein at least one of the one or more nozzles is adapted to direct a rinse agent towards an edge of a surface when the fluid delivery arm is disposed over the surface.

9. The substrate polishing apparatus of claim 4, wherein at least one of the one or more nozzles is adapted to direct a slurry toward a center of a surface when the fluid delivery arm is disposed over the surface.

10. The substrate polishing apparatus of claim 1, further comprising one or more nozzles disposed on the fluid delivery arm and connected to the fluid delivery line.

11. The substrate polishing apparatus of claim 10, wherein at least one of the one or more nozzles is mounted at a non-perpendicular angle from a horizontal plane of the fluid delivery arm.

12. A substrate polishing apparatus for supplying one or more fluids, comprising:

a) a fluid delivery arm;

b) one or more fluid delivery lies extending at least partially along a length of the fluid delivery arm; and c) a shield member disposed on the fluid delivery arm adapted to reduce splashing of the one or more fluids outwardly of the shield member, wherein the shield member comprises a first wall and a second wall disposed in parallel relation to one another along the length of the fluid delivery arm.

13. The substrate polishing apparatus of claim 12, further comprising a base having the fluid delivery arm rotatably connected thereto, wherein the fluid delivery arm extends radially outwardly from the base.

14. The substrate polishing apparatus of claim 12, wherein the one or more fluid delivery lines comprises a first delivery line connected to a source of slurry and a second delivery line connected to a source of rinse agent.

15. The substrate polishing apparatus of claim 12, further comprising one or more nozzles connected to the one or more fluid delivery lines.

16. The substrate polishing apparatus of claim 15, wherein at least one of the one or more nozzles is disposed downwardly from the fluid delivery arm.

17. The substrate polishing apparatus of claim 15, further comprising a base having the fluid delivery arm rotatably connected thereto, wherein the fluid delivery arm extends radially outwardly from the base and wherein at least one of the one or more nozzles is oriented in an inward direction toward the base.

18. The substrate polishing apparatus of claim 15, wherein the shield member comprises a first and a second wall portion disposed on opposite sides of the one or more nozzles.

19. The substrate polishing apparatus of claim 15, wherein at least one of the one or more nozzles is adapted to direct a rinse agent towards an edge of a surface when the fluid delivery arm is disposed over the surface.

20. The substrate polishing apparatus of claim 15, wherein the first and second wall of the shield member are disposed on opposite sides of the one or more nozzles.

21. The substrate polishing apparatus of claim 15, wherein at least one of the one or more nozzles is adapted to direct a slurry toward a center of a surface when the fluid delivery arm is disposed over the surface.

22. The substrate polishing apparatus of claim 12, further comprising one or more nozzles disposed on the fluid delivery arm and connected to the fluid delivery line.

23. The substrate polishing apparatus of claim 22, wherein at least one of the one or more nozzles is mounted at a non-perpendicular angle from a horizontal plane of the fluid delivery arm.

24. A substrate polishing apparatus for supplying one or more fluids, comprising:

a) a fluid delivery arm;

b) at least two fluid delivery lines comprising a rinse agent delivery line and a slurry delivery line extending at least partially along a length of the fluid delivery arm;

c) one or more nozzles connected to the at least two fluid delivery lines; and d) a shield member disposed on the fluid delivery arm adapted to reduce splashing of the one or more fluids outwardly of the shield member wherein the shield member comprises a first wall and a second wall disposed in parallel relation to one another along the length of the fluid delivery arm.

25. The substrate polishing apparatus of claim 24, wherein the rinse agent delivery lines is connected to a source of rinse agent and the slurry delivery line is connected to a source of slurry.

* * * * *

UNITED STATES PATENT AND TRADEMARK OFFICE

CERTIFICATE OF CORRECTION

PATENT NO. : 6,280,299 B1
DATED : August 28, 2001
INVENTOR(S) : Kennedy et al.

It is certified that error appears in the above-identified patent and that said Letters Patent is hereby corrected as shown below:

Column 1,
Line 4, please replace “This” with -- This is --.

Column 6,
Line 10, please replace “arms” with -- arms is --.
Line 43, please replace “am” with -- arm --.

Signed and Sealed this

Thirtieth Day of July, 2002

*Attest:*

*Attesting Officer*

JAMES E. ROGAN
*Director of the United States Patent and Trademark Office*